US007677012B2

(12) United States Patent
Cavilli et al.

(10) Patent No.: US 7,677,012 B2
(45) Date of Patent: Mar. 16, 2010

(54) UNIT FOR APPLYING OPENING DEVICES OF PACKAGES OF POURABLE FOOD PRODUCTS

(75) Inventors: Gianfranco Cavilli, San Vito (IT); Omar Succi, Modena (IT); Gabriele Borasi, Savignano Sul Panaro (IT); Danilo Veroni, Rubiera (IT); Bruno Sonzogni, Treviglio (IT)

(73) Assignee: Tetra Laval Holdings & Finance SA, Puly (CH)

( * ) Notice: Subject to any disclaimer, the term of this patent is extended or adjusted under 35 U.S.C. 154(b) by 407 days.

(21) Appl. No.: 10/551,034

(22) PCT Filed: Mar. 26, 2004

(86) PCT No.: PCT/EP2004/050380

§ 371 (c)(1),
(2), (4) Date: Jun. 16, 2006

(87) PCT Pub. No.: WO2004/085258

PCT Pub. Date: Oct. 7, 2004

(65) Prior Publication Data

US 2006/0236655 A1 Oct. 26, 2006

(30) Foreign Application Priority Data

Mar. 28, 2003 (EP) ..... 03007128

(51) Int. Cl.
*B65B 61/18* (2006.01)
*B65B 51/10* (2006.01)

(52) U.S. Cl. ..... 53/133.2; 53/302; 53/308; 53/329.4

(58) Field of Classification Search ..... 53/420, 53/133.1, 133.2, 302, 303, 304, 307, 308, 53/329, 329.2, 329.4
See application file for complete search history.

(56) References Cited

U.S. PATENT DOCUMENTS

| | | | | |
|---|---|---|---|---|
| 3,282,025 | A * | 11/1966 | Amberg et al. | 53/304 |
| 3,628,307 | A * | 12/1971 | Croasdale et al. | 53/303 |
| 3,673,663 | A | 7/1972 | Taddei | |
| 3,879,921 | A * | 4/1975 | Leonard | 53/329 |
| 3,908,340 | A * | 9/1975 | Erhardt | 53/329.4 |
| 4,065,909 | A * | 1/1978 | Mueller | 53/329.4 |

(Continued)

FOREIGN PATENT DOCUMENTS

EP 0113703 A1 7/1984

(Continued)

*Primary Examiner*—Louis K Huynh
(74) *Attorney, Agent, or Firm*—Buchanan, Ingersoll & Rooney, PC

(57) ABSTRACT

A unit for applying opening devices to packages of pourable food products having a rupturable portion includes a conveyor for feeding the packages successively along a given path; and a gripping device for receiving the opening devices at a pickup station, and which move cyclically between the pickup station and an application station interfacing with the path and where the opening devices are applied to respective packages; the trajectory of the gripping device from the application station to the pickup station is distinct from the path of the packages; and the unit also includes a pressure device generating a contact pressure between the packages and the opening devices as of the application station and along at least a portion of the path of the packages.

20 Claims, 4 Drawing Sheets

U.S. PATENT DOCUMENTS

| | | | | |
|---|---|---|---|---|
| 4,817,363 | A * | 4/1989 | St. Clair | 53/307 |
| 5,054,260 | A * | 10/1991 | Herzog | 53/307 |
| 5,284,001 | A * | 2/1994 | Ochs | 53/307 |
| 5,716,471 | A * | 2/1998 | Pape | 53/133.2 |
| 6,092,351 | A | 7/2000 | Imkamp et al. | |
| 6,378,271 | B1 * | 4/2002 | Skinner et al. | 53/133.2 |
| 6,402,019 | B1 * | 6/2002 | Casale | 53/329.2 |
| 6,701,692 | B1 * | 3/2004 | Niehr | 53/307 |
| 6,722,102 | B1 * | 4/2004 | Pape et al. | 53/133.2 |

FOREIGN PATENT DOCUMENTS

| | | | |
|---|---|---|---|
| EP | 1 215 124 | A1 | 6/2002 |
| EP | 1 215 143 | A1 | 6/2002 |
| EP | 1 215 144 | A1 | 6/2002 |
| WO | WO 97/04953 | A1 | 2/1997 |

* cited by examiner

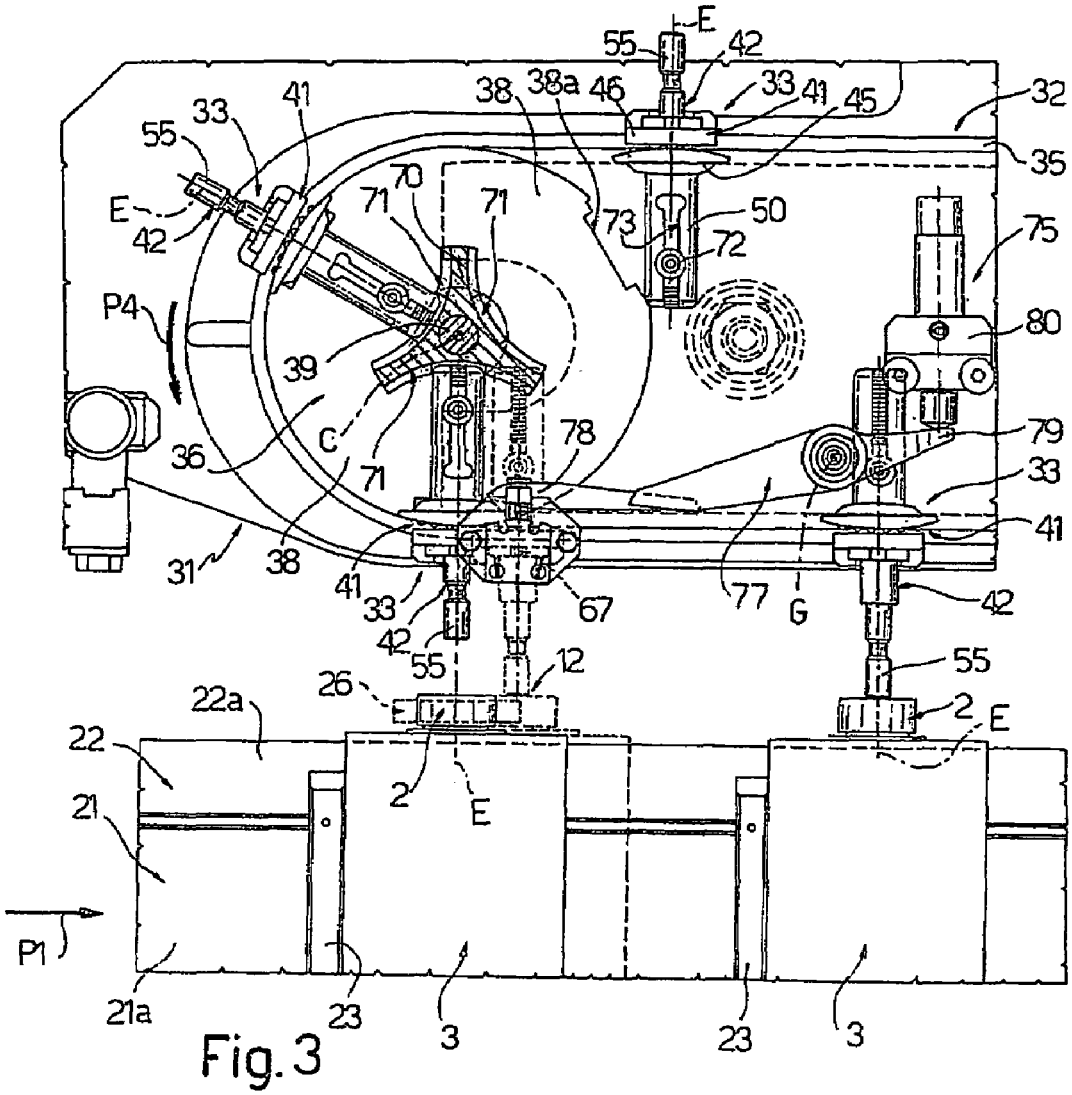
Fig. 3
Fig.4
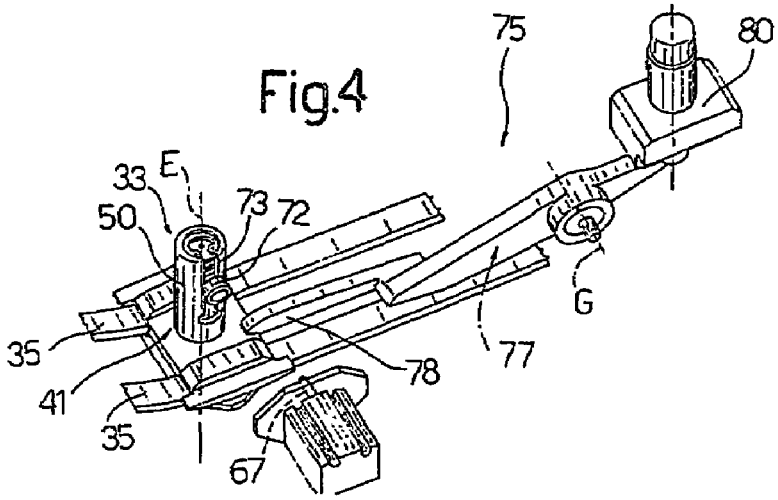

UNIT FOR APPLYING OPENING DEVICES OF PACKAGES OF POURABLE FOOD PRODUCTS

This application is the U.S. National Stage Application under 35 U.S.C. §371 of International Application No. PCT/EP2004/050380, filed on Mar. 26, 2004 designating the U.S., and claims priority under 35 U.S.C. §119 with respect to European Application No. 03007128.6, filed on Mar. 28, 2003, the entire contents of both of which are hereby incorporated by reference.

TECHNICAL FIELD

The present invention relates to a unit for applying opening devices to packages of pourable food products.

BACKGROUND ART

As is known, many pourable food products, such as fruit juice, UHT (ultra-high-temperature-treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing a web of laminated packaging material. The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of oxygen-barrier material, defined, for example, by aluminium foil, which is superimposed on a layer of heat-seal plastic material, and is in turn covered with another layer of heat-seal plastic material eventually defining the inner face of the package contacting the food product.

As is known, such packages are produced on fully automatic packaging machines, on which a continuous tube is formed from the web-fed packaging material; the web of packaging material is sterilized on the packaging machine itself, e.g. by applying a chemical sterilizing agent, such as a hydrogen peroxide solution, which, once sterilization is completed, is removed, e.g. vapourized by heating, from the surfaces of the packaging material; and the web of packaging material so sterilized is kept in a closed, sterile environment, and is folded and sealed longitudinally to form a vertical tube.

The tube is filled with the sterilized or sterile-processed food product, and is sealed and cut along equally spaced transverse sections to form pillow packs, which are then folded mechanically to form the finished, e.g. substantially parallelepiped-shaped, packages.

Alternatively, the packaging material may be cut into blanks, which are folded on forming spindles into packages, which are then filled with the food product and sealed. One example of the this type of package is the so-called "gable-top" package known by the trade name Tetra Rex (registered trademark).

Once formed, packages of the above type may undergo further operations, such as application of a closable opening device.

The most commonly marketed opening devices comprise a frame defining an opening and fitted about a rupturable or removable portion of the top wall of the package; and a cap hinged or screwed to the frame, and which is removable to open the package. Alternatively, other, e.g. slidable, opening devices are also known to be used.

The rupturable portion of the package may be defined, for example, by a so-called "prelaminated" hole, i.e. a hole formed in the fibrous layer of the packaging material before it is covered with the barrier layer, which thus remains whole and closes the hole to ensure airtight, aseptic sealing, while at the same time being easily rupturable.

In the case of aseptic packaging machines, the opening devices described are normally applied continuously, straight onto the formed packages, by on-line applicator units downstream from the packaging machine.

Applying the opening devices, e.g. by heat sealing or gluing, involves various preparatory operations on both the package and opening device. More specifically, when heat sealing the opening device to the package, both the opening device and the heat-seal outer layer of the packaging material surrounding the rupturable portion of the package are preheated to produce partial melting or local softening.

Once applied to the package, pressure must be applied to hold the opening device on the package long enough for the contacting materials to cool and adhere.

Similarly, when gluing the opening device to the package, one or both of the parts being glued must be coated with a layer of adhesive, and then held firmly contacting each other long enough for adhesion to take place.

EP-A-1 215 124, EP-A-1 215 143 and EP-A-1 215 144 describe opening device applicator units, which substantially comprise a continuously-rotating carousel conveyor for conveying the packages from a loading station to an unloading station, and the opening devices from a feed station to an application station interposed between the package loading and unloading stations, and where the opening devices are applied to the respective packages.

More specifically, the carousel conveyor is fitted integrally with a number of seating devices for housing respective packages, and which travel continuously along a circular path extending successively through the package loading station, a localized-heating station for heating around the rupturable portion of the packages, the opening device application station, and, finally, the package unloading station.

The carousel conveyor also comprises a number of applicator devices, each associated with a respective seating device, and which also travel along a circular path over the path of the seating devices.

The opening devices are fed to the respective applicator devices at the feed station, and are fed by the carousel conveyor through a number of heating stations before reaching the application station where they are applied to the respective packages.

Being much thicker than the outermost layer of the packages, the opening devices take much longer to heat than the packages.

Which is why, as compared with the packages, the opening devices call for more heating stations, and must be kept much longer in each.

In the applicator units in the above patents, the problem has been solved by moving the carousel conveyor, and the seating devices integral with it, at constant speed along the relative path, and by connecting the applicator devices to the carousel conveyor by means of variable-speed feed assemblies controlled by a cam system.

More specifically, the feed assemblies provide for feeding the applicator devices in steps at the heating stations, so that the opening devices are kept at the heating stations as long as possible, and for feeding the applicator devices integrally with the carousel conveyor along other portions of their path, and particularly downstream from the application station, where the applicator devices must ensure firm contact between the packages and the opening devices to allow the heat-seal material to cool and so achieve adhesion.

Applicator units of the type briefly described above have various drawbacks.

In particular, the carousel conveyor for both conveying the packages and applying the opening devices is extremely complex and expensive, mainly owing to certain operations, in particular heating of the opening devices, being of minimum duration, which is incompatible with the time taken by the carousel conveyor to travel through a fixed station, so that complex mechanisms are required to release at least portions of the movement of the applicator devices from that of the carousel conveyor.

Moreover, given the continuous movement of the carousel conveyor, and the fact that, over at least part of their respective paths, the applicator and seating devices must travel jointly to enable the opening devices to be applied to and held firmly on the respective packages, the hold time of the applicator devices at the heating stations can only be maximized by imposing sharp acceleration and braking on nearing and leaving the stations, thus resulting in possible dynamic problems.

DISCLOSURE OF INVENTION

It is an object of the present invention to provide a unit for applying opening devices to packages of pourable food products, designed to provide a straightforward, low-cost solution to the aforementioned drawbacks typically associated with known units.

BRIEF DESCRIPTION OF THE DRAWINGS

A preferred, non-limiting embodiment of the present invention will be described by way of example with reference to the accompanying drawings, in which:

FIG. 3 shows a larger-scale side view of a portion of the FIG. 2 pressure device;

FIG. 4 shows a larger-scale view in perspective of a detail in FIG. 3;

BEST MODE FOR CARRYING OUT THE INVENTION

Figure 1:
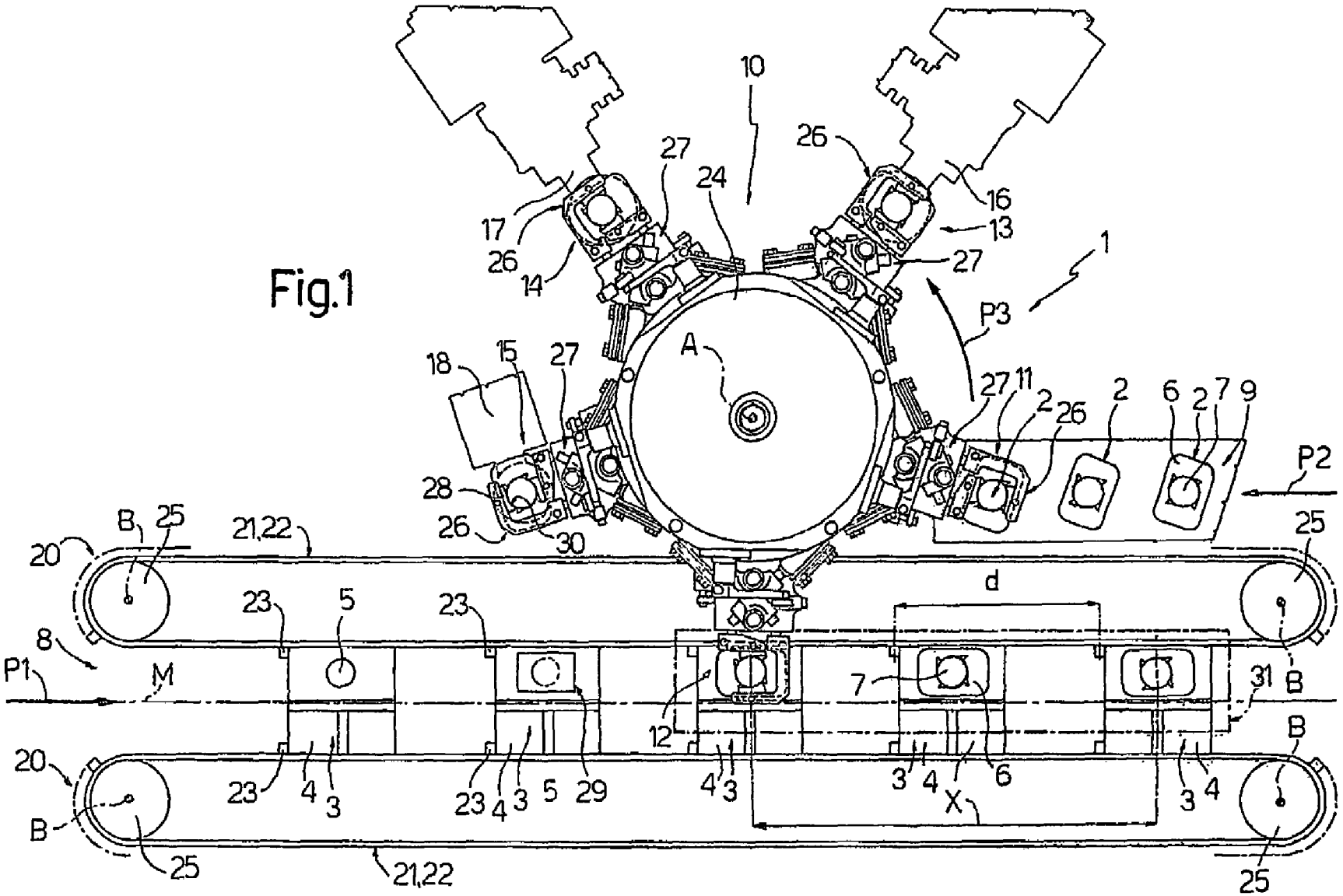
FIG. 1 shows a schematic plan view of a unit, in accordance with the present invention, for applying opening devices to packages of pourable food products.

Number 1 in FIG. 1 indicates as a whole a unit for applying opening devices 2 to sealed packages 3 of pourable food products.

Packages 3 are produced upstream from unit 1, as described previously, from a sheet packaging material comprising a layer of fibrous material covered on both sides with layers of heat-seal plastic material, e.g. polyethylene. In the case of aseptic packages 3 for long-storage products, such as UHT milk, the packaging material also comprises a layer of oxygen-barrier material, defined, for example, by aluminium foil, which is superimposed on a layer of heat-seal plastic material, and is in turn covered with another layer of heat-seal plastic material eventually defining the inner face of packages 3 contacting the food product.

Packages 3, which are substantially parallelepiped-shaped in the example shown, comprise, on a top wall 4, a rupturable portion 5 conveniently defined by a so-called "prelaminated" hole, i.e. a hole formed in the fibrous layer of the packaging material before the fibrous layer is covered with the barrier layer, which closes the hole to ensure aseptic, airtight sealing, while at the same time being easily rupturable.

Opening devices 2 are made of thermoplastic material, and each comprise, in known manner, a frame 6, which is heat sealed about a rupturable portion 5 on wall 4 of a respective package 3, and defines a pour opening (not shown); and a cap 7 or cover, which is screwed or hinged to the frame to close the pour opening. Opening devices 2 conveniently comprise known means (not shown) for piercing or removing rupturable portion 5 of package 3 to unseal the package.

Unit 1 comprises a first linear step conveyor 8 for conveying a succession of packages 3 along a preferably straight path P1; a second linear step conveyor 9 for conveying a succession of opening devices 2 along a straight path P2—in the example shown, parallel to and in the opposite direction to path P1; and a carousel conveyor 10, step-operated in known manner not shown, to feed opening devices 2 from a pickup station 11, coincident with one of the stop stations of second conveyor 9, to an application station 12 where opening devices 2 are applied to respective packages 3, and which is coincident with one of the stop stations of first conveyor 8.

More specifically, carousel conveyor 10 feeds opening devices 2, along a circular path P3 with a vertical axis A, through a number of intermediate work stations 13, 14, 15, where opening devices 2 are stopped and heated to partly melt the material. More specifically, stations 13 and 14 have respective hot-air heaters 16, 17 for generating and directing respective hot-air jets underneath opening devices 2 at respective stations 13, 14; and station 15 has a hydrogen burner 18, which generates a microflame for locally melting the thermoplastic material of opening device 2.

First conveyor 8 comprises a movable, horizontal bottom surface 19 defined by a continuous belt or by a number of adjacent elements, and defining a supporting surface for packages 3; and lateral belt feed devices 20 cooperating with respective opposite sides of packages 3. More specifically, the two feed devices 20 are symmetrical with respect to a vertical plane M containing path P1, and which is perpendicular to movable surface 19 and parallel to axis A; and each feed device 20 comprises a number of first belts 21 and a number of second belts 22, which have respective active branches 21*a*, 22*a* parallel to and facing plane M (FIGS. 1 and 2), and are looped about two pulleys 25 having vertical axes B parallel to axis A. Belts 21 alternate vertically with belts 22, and cooperate, by means of active branches 21*a*, with a lateral face of packages 3; and belts 22, whose active branches 22*a* do not contact packages 3, are fitted with a number of vertical feed bars 23 equally spaced by a distance d defining the spacing of packages 3 on first conveyor 8. The position of each package 3 on first conveyor 8 is therefore unequivocally determined transversely by contact with movable surface 19 and branches 21*a* of belts 21, and longitudinally by contact with two bars 23 forming part of respective feed devices 20.

A heating device 29—known and shown only schematically in FIG. 1—is located along first conveyor 8, at a heating station immediately upstream from application station 12, and provides for directing an air jet about rupturable portion 5 on top wall 4 of package 3 to melt the heat-seal outer layer of the packaging material.

Carousel conveyor 10, which is only described as required for a clear understanding of the present invention, is located on the same side of first conveyor 8 as second conveyor 9, and substantially comprises a central body 24 of axis A, from which project radially outwards a number of grippers 26 for gripping opening devices 2, and equal in number to the stations of carousel conveyor 10. More specifically, grippers 26 are equally spaced about central body 24, and are connected to it by respective supporting assemblies 27 not described in detail by not being pertinent to a clear understanding of the present invention.

Each gripper 26 is substantially C-shaped, and is defined by two jaws 28 connected to relative supporting assembly 27 and defining a seat 30 for a respective opening device 2, which seat is open on both sides in a direction parallel to axis A, and on the trailing side in the travelling direction of gripper 26 along path P3. The two jaws 28 of each gripper 26 are movable in conventional manner with respect to each other to insert and retain a respective opening device 2 inside seat 30. More specifically, grippers 26 extend over first conveyor 8 to feed opening devices 2 in a plane parallel to movable surface 19 and at such a distance from movable surface 19 as to enable opening devices 2 to be applied to top walls 4 of respective packages 3.

At application station 12, one of grippers 26 of carousel conveyor 10 is positioned facing movable surface 19, and defines a predetermined application position in which to apply opening devices 2 to respective packages 3.

Path P1 of packages 3 and path P3 of opening devices 2 therefore have only one interface defined by application station 12, so that the trajectory of grippers 26 from application station 12 to pickup station 11 is distinct from path P1.

An important characteristic of the present invention lies in unit 1 also comprising a pressure device 31 (FIGS. 2 and 3), which extends facing conveyor 8 along part of path P1, and exerts pressure on opening devices 2, as of application station 12, to release them from respective grippers 26, apply them to respective packages 3, and keep them pressed firmly on the packages along a predetermined portion X of path P1 long enough, with respect to the speed of first conveyor 8, to allow the contacting thermoplastic materials to cool and adhere.

Device 31 comprises a belt conveyor 32 over first conveyor 8 and extending from application station 12 to the package 3 output of unit 1; and a number of equally spaced pressure members 33 projecting from conveyor 32, and each of which, as of application station 12, acts on a respective opening device 2 to apply it to and keep it pressed firmly on a respective package 3.

More specifically, conveyor 32 feeds pressure members 33 along an endless path P4 interfacing path P1 along portion X from application station 12.

Conveyor 32 comprises two belts 35 looped parallel to each other about two pulleys 36, 37—one of which is powered—having axes C, D perpendicular to axes A, B and to paths P1, P2, and located close to application station 12 and the package 3 output of unit 1 respectively. Belts 35 are spaced apart in a direction parallel to axes C and D, and have respective straight active branches 35*a* facing and parallel to movable surface 19 and to portion X of path P1. Each belt 35 also comprises a secondary branch 35*b* parallel to and facing active branch 35*a*; and two curved portions 35*c*, 35*d* connecting branches 35*a*, 35*b* and looped about respective pulleys 36, 37.

Each pressure member 33 is fixed to and projects from both belts 35, extends through belts 35 in a direction perpendicular to the surface defined by them, and projects from both sides of said surface.

Each pulley 36, 37 is defined by two peripherally grooved wheels 38, which are engaged by respective belts 35, and are fitted, axially spaced, to a relative central supporting shaft 39 of axis C, D, so as to define a seat for the passage of the parts of pressure members 33 projecting inwards of belts 35.

Figure 5:
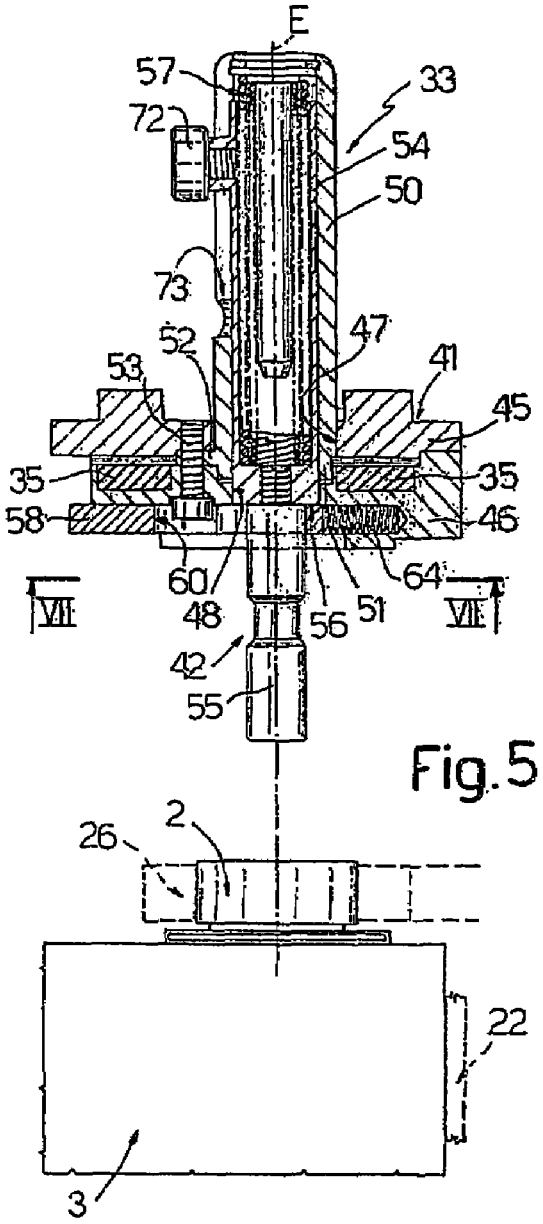
FIGS. 5 and 6 show larger-scale, partly sectioned side views of an actuating member of the pressure device in two different operating positions.
Figure 6:
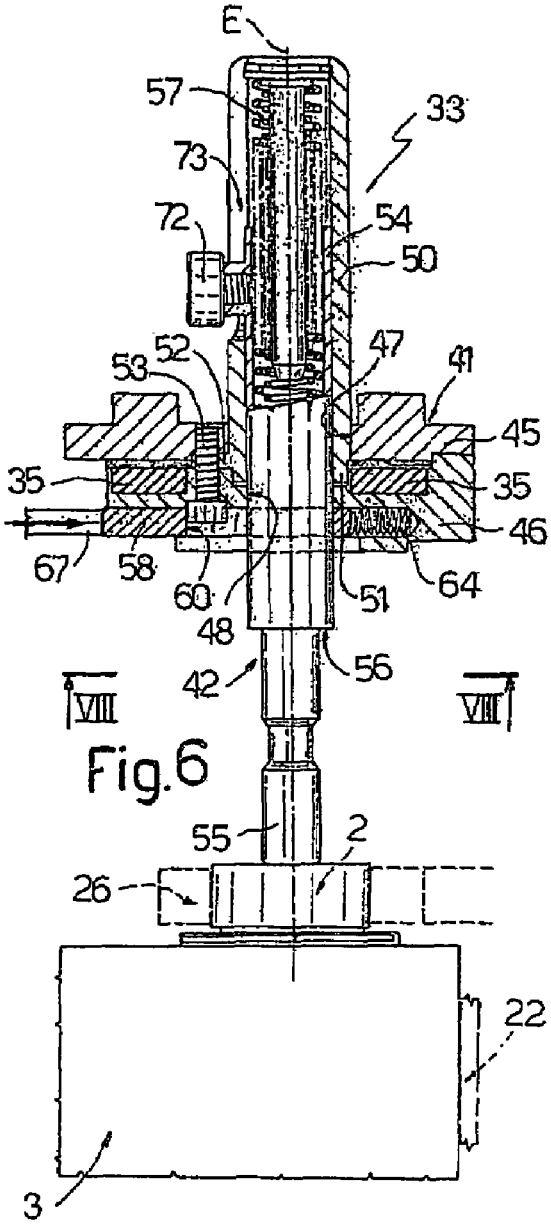
Figure 7:
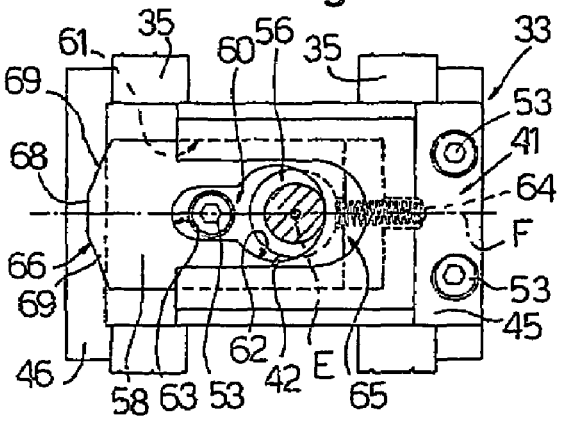
FIGS. 7 and 8 show sections along lines VII-VII and VIII-VIII in FIGS. 5 and 6 respectively.
Figure 8:
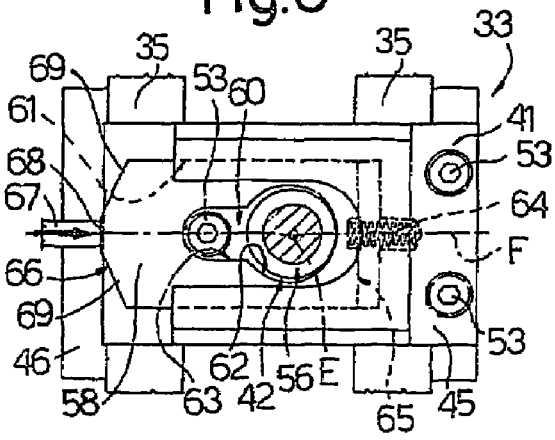

FIGS. 5 and 6 show a pressure member 33 fixed to relative portions of belts 35. Since the other pressure members 33 of device 31 are obviously identical, the following description is limited to the pressure member 33 shown.

Pressure member 33 substantially comprises a support 41 fixed integrally to belts 35; and an actuating member 42 fitted to support 41 to move, along a respective axis E perpendicular to belts 35, between an extracted work position (FIG. 6) interacting with a relative opening device 2, and a withdrawn rest position (FIG. 5).

Along branches 35*a*, 35*b* of belts 35, actuating member 42 therefore extends vertically, i.e. parallel to axis A and perpendicular to the feed plane of packages 3 along path P1 or, in other words, to walls 4 of packages 3.

Figure 2:
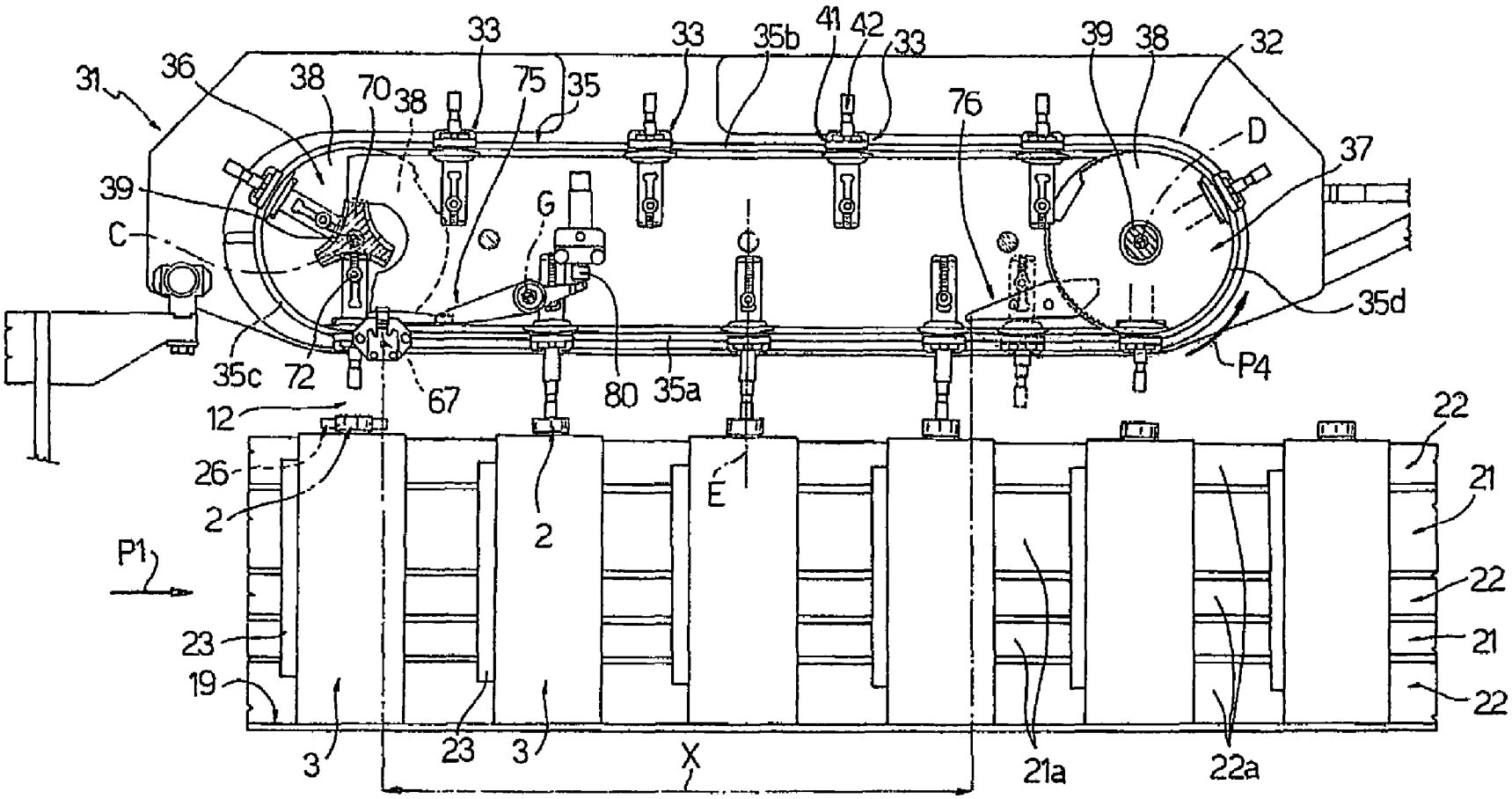
FIG. 2 shows a larger-scale side view, with parts removed for clarity, of part of the FIG. 1 unit comprising a pressure device for maintaining contact pressure between the packages and opening devices once the opening devices are applied.

As shown particularly in FIGS. 5 to 8, support 41 has opposite lateral end portions, which project transversely from respective belts 35, and, at each pulley 36, 37, engage respective peripheral cavities 38*a* formed on respective wheels 38. As shown in FIGS. 2 and 3, each wheel 38 has a number of cavities 38*a* equally spaced about relative axis C, D.

More specifically, support 41 substantially comprises two plates 45, 46 gripping belts 35 on the inner and outer side respectively, and having respective through holes 47, 48 of axis E; and a cylindrical cup-shaped sleeve 50, which defines a slide seat for actuating member 42, extends perpendicularly inwards of conveyor 32 from plate 45, and has an open end portion 51 engaging hole 47 in plate 45 and having a peripheral flange 52 gripped between plates 45 and 46.

More specifically, plates 45 and 46 and flange 52 of sleeve 50 grip belts 35 by means of a number of screws 53.

The open end portion 51 of sleeve 50 rests on the lateral edge of hole 48 in plate 46, and is aligned internally with hole 48.

Actuating member 42 comprises a main portion 54 in the form of a cylindrical rod and fitted in axially-sliding manner inside sleeve 50; and a cylindrical end work head 55, which projects outwards of belts 35, cooperates with opening devices 2, and has an outside diameter smaller than that of main portion 54, so as to define, with main portion 54, an annular shoulder 56.

Main portion 54 of actuating member 42 is hollow, and houses elastic means 57—in the example shown, two coaxial garter springs—interposed between the closed end portion of sleeve 50 and an inner shoulder of main portion 54.

Actuating member 42 is loaded axially by elastic means 57 into the extracted work position (FIG. 6), in which it projects a maximum distance outwards of belts 35 from support 41.

Pressure member 33 also comprises a control plate 58 for controlling the position of actuating member 42, and which has a contoured through opening 60, and is fitted in sliding manner—in a direction F perpendicular to axis E and to path P1—inside a C-shaped seat 61 in plate 46 to allow or prevent displacement of actuating member 42 into the extracted work position through opening 60.

More specifically, opening 60 is defined by a circular portion 62 (FIGS. 7 and 8) of the same diameter as hole 48, and by a straight appendix 63 extending in direction F from one side of circular portion 62 and engaged loosely in direction F by the head of one of screws 53.

Plate 58 is substantially rectangular, and is loaded by a garter spring 64—interposed between an end edge 65 of plate 58 and an end portion of seat 61—into a disabling position (FIG. 7), in which circular portion 62 of opening 60 is offset with respect to hole 48, and part of the lateral edge of circular portion 62 defines a stop surface for shoulder 56 of actuating member 42. In which condition (withdrawn rest position), only work head 55 of actuating member 42 projects outwards of belts 35 from plate 46, and, being shorter than the distance between plate 46 and the feed plane of opening devices 2, is prevented from interacting with the opening devices.

Moreover, in the withdrawn rest position (FIG. 5), work head 55, by engaging circular portion 62 of opening 60, defines a stop preventing plate 58 from being expelled from seat 61 by spring 64.

A contoured edge 66 of plate 58 projects outwards of seat 61, and is defined by a straight central portion 68 parallel to path P1, and by opposite ramp-shaped end portions 69 diverging from central portion 68.

Plate 58 is movable, in opposition to spring 64, into an enabling position (FIG. 8), in which circular portion 62 of opening 60 is aligned with hole 48 in plate 46, and allows actuating member 42 to be pushed into the extracted work position by elastic means 57.

Plate 58 is moved by edge 66 interacting with a fixed pin 67 at application station 12. More specifically, as belts 35 advance, the downstream ramp-shaped end portion 69 and central portion 68 of edge 66 of plate 58 slide successively along the head of pin 67, which thus moves plate 58 gradually in direction F in opposition to spring 64.

To prevent the reaction of elastic means 57 from being discharged solely on belts 35 when moving actuating member 42 into the extracted work position, the portion of shaft 39 of pulley 36 interposed between the two wheels 38 is advantageously fitted externally with a hub 70 bounded outwards by a number of concave arc-shaped surfaces 71, each of which is engaged by the closed end portion of sleeve 50 of a relative pressure member 33, so that, at application station 12, the reaction of elastic means 57 of each pressure member 33 is transmitted to a relative arc-shaped surface 71 of hub 70, and by hub 70 to the supports of shaft 39 of pulley 36.

Actuating member 42 also comprises an actuating pin 72 projecting from one side of main portion 54, and engaging in sliding manner a slot 73 formed along the lateral wall of sleeve 50 and elongated parallel to axis E.

As pressure member 33 travels along the trajectory imposed by conveyor 32, actuating pin 72 cooperates, at application station 12, with a damping mechanism 75 for controlling impact of actuating member 42 on relative opening device 2, and, close to pulley 37, with a fixed guide member 76 to restore actuating member 42 to the withdrawn rest position in opposition to elastic means 57.

The damping mechanism (FIGS. 2, 3 and 4) substantially comprises a rocker arm 77 hinged at an intermediate point about a fixed axis G parallel to direction F, and having a first end portion 78 located at application station 12 and along the vertical trajectory of actuating pin 72 of the pressure member 33 travelling through station 12, and a second end portion 79 loaded by a known damper 80, e.g. an air spring.

Guide member 76 is substantially defined by an inclined surface sloping upwards in the travelling direction of pressure members 33, and which cooperates in sliding manner with actuating pin 72 of a relative actuating member 42 to move actuating member 42 along axis E in opposition to elastic means 57, and so release main portion 54 from circular portion 62 of opening 60 in plate 58, so that spring 64 clicks plate 58 into the disabling position.

Operation of unit 1, which in part is already obvious from the foregoing description, is as follows.

First and second conveyor 8 and 9, carousel conveyor 10, and pressure device 31 are all step-operated synchronously, so that, for each step of conveyors 8 and 9, carousel conveyor 10 rotates one step, and pressure device 31 moves one step forward.

Operation of unit 1 will be described with reference to one package 3 fed by first conveyor 8 along path P1, and to one opening device 2 engaged by a relative gripper 26, fed by carousel conveyor 10 along path P3 from pickup station 11, and subjected in known manner to respective heating operations at work stations 13, 14, 15.

More specifically, at work stations 13 and 14, respective hot-air jets are directed onto opening device 2 to soften the underside surface of frame 6 eventually contacting package 3; and, at work station 15, opening device 2 is subjected to the microflame generated by burner 18 to melt a surface layer of the opening device material.

At the same time, upstream from application station 12, a hot-air jet generated by heating device 29 is directed about rupturable portion 5 of top wall 4 of package 3 to soften the surface layer of the packaging material.

At application station 12, gripper 26 sets opening device 2 to the position in which it is to be applied about rupturable portion 5 of package 3 underneath.

At the same time, a pressure member 33 approaches application station 12, with actuating member 42 in the withdrawn rest position.

More specifically, as it travels about pulley 36, the closed end portion of sleeve 50 of pressure member 33 cooperates with a relative arc-shaped surface 71 of hub 70, and continues engaging it along the whole portion in which belts 35 interact with pulley 36.

On approaching application station 12, the free edge 66 of plate 58 of pressure member 33 strikes fixed pin 67, and is moved by it from the disabling position (FIG. 7) to the enabling position (FIG. 8), so that circular portion 62 of opening 60 in plate 58 is aligned with hole 48 in plate 46, and actuating member 42 is pushed down by elastic means 57 into the extracted work position.

As actuating member 42 is pushed down, actuating pin 72 strikes end portion 78 of rocker arm 77, and the action of damper 80 on the opposite end portion 79 of rocker arm 77 cushions the impact of work head 55 on opening device 2.

The retaining force exerted by actuating member 42 on opening device 2 releases the opening device from gripper 26, which continues travelling along path P3 to pickup station 11. In other words, being open on the trailing side along path P3, gripper 26 releases opening device 2 easily without interfering with the actuating member.

Actuating member 42 remains contacting opening device 2 along the whole of portion X of path P1, and generates a contact pressure between opening device 2 and package 3 by virtue of the force exerted by elastic means 57.

At the end of portion X of path P1, actuating pin 72 encounters fixed guide member 76, which moves it along relative slot 73 in sleeve 50 in opposition to elastic means 57; actuating member 42 is therefore moved into the withdrawn rest position, and is detached from opening device 2, by now sealed to package 3; and, upon main portion 54 of actuating member 42 releasing circular portion 62 of opening 60, spring 64 clicks plate 58 into the disabling position locking actuator member 42 in the withdrawn rest position.

The advantages of unit 1 according to the present invention will be clear from the foregoing description.

In particular, the fact that only opening devices 2, and not packages 3, are conveyed on carousel conveyor 10, and that opening devices 2 are applied to and held firmly on respective packages 3 by a dedicated device (31), simplifies and reduces the overall cost of unit 1, while at the same time improving and simplifying control of the various operations involved, as compared with known units.

With the sole exception of activating and deactivating actuating members 42, the unit described has no other parts in relative motion, thus drastically reducing dynamic problems, and improving reliability as a whole.

By using elastic means 57 to operate each actuating device 42, a predetermined load on opening devices 2 can be assured to compensate for any differences in the height of packages 3 as a result of inevitable manufacturing tolerances.

Clearly, changes may be made to unit 1 as described herein without, however, departing from the scope of the accompanying Claims.

In particular, opening devices 2 may be glued, as opposed to heat sealed, to packages, 3; in which case, the heating operations are replaced by the application of adhesive.

The invention claimed is:

1. A unit for applying opening devices to packages of pourable food products having a rupturable portion, the unit comprising:

a conveyor for feeding the packages successively along a linear path;

a plurality of grippers rotatable about a common axis so that the grippers move along a circular path from a pickup station at which each gripper receives one of the opening devices to an application station and said plurality of grippers having a trajectory interfacing with the linear path and at which the opening device is applied to one of the packages; and a movable pressure member separate from the grippers and movable along at least a portion of the linear path and including the application station to press the opening device against the package during the feeding of the package.

2. A unit for applying opening devices to packages of pourable food products having a rupturable portion, the unit comprising:

a first conveyor for feeding said packages successively along a first path; and a second conveyor carrying gripping means for receiving said opening devices at a pickup station, and which gripping means move cyclically between said pickup station and an application station and said second conveyor having a trajectory interfacing with said first path and where the opening devices are applied to respective said packages;

wherein a trajectory of said gripping means from said application station to said pickup station is distinct from said first path, and wherein the unit also comprises a third conveyor carrying pressure means along a second path, said third conveyor having a trajectory interfacing with said first path along at least a portion at said application station, said pressure means generating a contact pressure between said packages and said opening devices along at least said portion of said first path.

3. A unit as claimed in claim 2, wherein said pressure means comprise a number of pressure members, which act on respective said opening devices to press them onto respective said packages in a direction crosswise to a feed plane of the packages along said first path.

4. A unit as claimed in claim 3, wherein each said pressure member comprises a support integral with said third conveyor; and an actuating member fitted to said support to move along an axis perpendicular to the feed plane of said packages along said first path, and which is movable between a work position, in which it acts on a relative said opening device to keep it pressed on the relative said package, and a rest position, in which it is detached from said opening devices.

5. A unit as claimed in claim 4, wherein said gripping means define at least one seat for retaining a relative said opening device, and which is open on both sides in a direction parallel to said axis of movement of each said actuating member, and on the trailing side in the traveling direction of the gripping means from said application station to said pickup station.

6. A unit as claimed in claim 5, wherein said pressure means comprise control means for moving said actuating members into said work position along said portion of said first path, and into said rest position along the rest of said second path.

7. A unit as claimed in claim 4, wherein said pressure means comprise control means for moving said actuating members into said work position along said portion of said first path, and into said rest position along the rest of said second path.

8. A unit as claimed in claim 7, comprising fixed guide means located at an end portion of said portion of said first path, and interacting with an actuating portion of each said actuating member to restore the actuating member to said rest position in opposition to said first elastic means.

9. A unit as claimed in claim 8, comprising damping means located at said application station and interacting with each said actuating member being moved into said work position by said first elastic means, to control the impact of the actuating member on the relative said opening device.

10. A unit as claimed in claim 7, comprising damping means located at said application station and interacting with each said actuating member being moved into said work position by said first elastic means, to control the impact of the actuating member on the relative said opening device.

11. A unit as claimed in claim 10, wherein said damping means comprise a rocker arm hinged at an intermediate point about an axis crosswise to the axis of movement of each said actuating member, and having a first end portion located at said application station and along the trajectory of a portion of the actuating member, and a second end portion loaded by a damper.

12. A unit as claimed in claim 7, wherein, for each said pressure member, said control means comprise first elastic means for loading the relative said actuating member into said work position; and retaining means fitted to the relative said support to move between a disabling position retaining said actuating member in said rest position in opposition to said first elastic means, and an enabling position allowing said actuating member to move into said work position.

13. A unit as claimed in claim 12, comprising fixed guide means located at an end portion of said portion of said first path, and interacting with an actuating portion of each said actuating member to restore the actuating member to said rest position in opposition to said first elastic means.

14. A unit as claimed in claim 12, comprising damping means located at said application station and interacting with each said actuating member being moved into said work position by said first elastic means, to control the impact of the actuating member on the relative said opening device.

15. A unit as claimed In claim 12, wherein said support of each said pressure member comprises a hollow body having an open end portion facing said packages and housing the relative said actuating member and said first elastic means; said retaining means of each said pressure member comprising a movable member fitted to the relative said support to move in a direction crosswise to said axis of movement of the relative said actuating member, and which interferes with said open end portion of the relative said hollow body in said disabling position to prevent the actuating member from being moved into the work position by said first elastic means.

16. A unit as claimed in claim 15, comprising fixed guide means located at an end portion of said portion of said first path, and interacting with an actuating portion of each said actuating member to restore the actuating member to said rest position in opposition to said first elastic means.

17. A unit as claimed in claim 15, comprising damping means located at said application station and interacting with each said actuating member being moved into said work position by said first elastic means, to control the impact of the actuating member on the relative said opening device.

18. A unit as claimed in claim 15, wherein each said movable member is loaded by second elastic means into said disabling position; and in that said control means comprise interacting means located at said application station and acting on each said movable member, in opposition to the relative said second elastic means and as the relative said pressure member travels along said portion of said first path, so as to move the movable member into said enabling position.

19. A unit as claimed in claim 18, comprising fixed guide means located at an end portion of said portion of said first path, and interacting with an actuating portion of each said actuating member to restore the actuating member to said rest position in opposition to said first elastic means.

20. A unit as claimed in claim 18, comprising damping means located at said application station and interacting with each said actuating member being moved into said work position by said first elastic means, to control the impact of the actuating member on the relative said opening device.

* * * * *